US010151463B2

(12) United States Patent
Kwong

(10) Patent No.: US 10,151,463 B2
(45) **Date of Patent: *Dec. 11, 2018**

(54) LED LIGHT BULB AND LIGHTING FIXTURE

(71) Applicant: Gardenia Industrial Limited, Tortola (VG)

(72) Inventor: Hing Chuen Allan Kwong, Zhong Shan (CN)

(73) Assignee: Gardenia Industrial Limited, Tortola (VG)

( * ) Notice: Subject to any disclaimer, the term of this patent is extended or adjusted under 35 U.S.C. 154(b) by 0 days.

This patent is subject to a terminal disclaimer.

(21) Appl. No.: 15/895,617

(22) Filed: Feb. 13, 2018

(65) Prior Publication Data

US 2018/0172251 A1 Jun. 21, 2018

Related U.S. Application Data

(63) Continuation of application No. 15/093,568, filed on Apr. 7, 2016, now Pat. No. 9,927,104.

(30) Foreign Application Priority Data

Jun. 26, 2015 (CN) ..... 2015 2 0455889 U

(51) Int. Cl.

| | |
|---|---|
| ***F21V 29/00*** | (2015.01) |
| ***F21V 21/116*** | (2006.01) |
| ***F21V 29/77*** | (2015.01) |
| ***F21S 8/06*** | (2006.01) |
| ***F21V 17/12*** | (2006.01) |

(Continued)

(52) U.S. Cl.

CPC ..... *F21V 21/116* (2013.01); *F21K 9/20* (2016.08); *F21S 8/065* (2013.01); *F21V 17/12* (2013.01); *F21V 23/002* (2013.01); *F21V 29/773* (2015.01); *F21V 21/108* (2013.01); *F21Y 2115/10* (2016.08)

(58) Field of Classification Search

CPC ..... F21V 29/77; F21V 29/773; F21V 29/777
USPC ..... 362/294, 405
See application file for complete search history.

(56) References Cited

U.S. PATENT DOCUMENTS 8,283,844 B2 * 10/2012 Cho ..... F21V 5/04 313/113
8,696,160 B2 * 4/2014 McClellan ..... F21S 2/005 362/249.02

(Continued)

*Primary Examiner* — Evan Dzierzynski
*Assistant Examiner* — Keith G Delahoussaye
(74) *Attorney, Agent, or Firm* — Lewis Roca Rothgerber Christie LLP

(57) ABSTRACT

An LED light bulb including a heat sink including a base and series of cooling fins arranged around the base defining external threads, an LED light board including at least one LED light on an upper end of the heat sink, a pressure ring surrounding the LED light board on the upper end of the heat sink, and a translucent cover configured to cover the LED light board. The translucent cover includes a cover body and a series of hooks extending from the cover body. Each hook includes a resilient arm and an elastic arm extending inward from a free distal end of the resilient arm. When the translucent cover is connected to the pressure ring, a lower edge of the cover body is pressed against an upper surface of the pressure ring and the elastic arms are pressed against a lower surface of the pressure ring.

17 Claims, 14 Drawing Sheets

(51) Int. Cl.

| | |
|---|---|
| ***F21V 23/00*** | (2015.01) |
| ***F21K 9/20*** | (2016.01) |
| *F21V 21/108* | (2006.01) |
| *F21Y 115/10* | (2016.01) |

(56) References Cited

U.S. PATENT DOCUMENTS

| | | | | |
|---|---|---|---|---|
| 8,985,815 | B2 * | 3/2015 | Chen | F21V 23/023 362/294 |
| 2004/0066142 | A1 * | 4/2004 | Stimac | H05B 33/0803 315/50 |
| 2004/0114377 | A1 * | 6/2004 | Mas-Quiles | F21S 8/065 362/405 |
| 2006/0146548 | A1 | 7/2006 | Pazula et al. | |
| 2011/0109217 | A1 | 5/2011 | Kang et al. | |
| 2014/0268803 | A1 | 9/2014 | Keng | |

* cited by examiner

C – C

E - E

LED LIGHT BULB AND LIGHTING FIXTURE

CROSS-REFERENCE TO RELATED APPLICATION(S)

The present application is a continuation of U.S. application Ser. No. 15/093,568, filed Apr. 7, 2016, which claims priority to and the benefit of Chinese Application No. 201520455889.2, filed on Jun. 26, 2015, the entire contents of both of which are incorporated herein by reference.

FIELD

The present disclosure relates generally to light emitting diode light bulbs and lighting fixtures.

BACKGROUND

Related art light-emitting diode (LED) light bulbs, such as the LED bulb shown in FIG. 1, typically include a translucent cover 101, a heat sink casing 102, an LED light board (not shown) having at least one LED, a power driver module (not shown in FIG. 1) coupled to the LED light board, and a cap 103 having external threads configured to facilitate coupling the LED light bulb to a socket. In related art LED light bulbs, the power driver module is typically fixed within the heat sink casing 102 with a complex structure.

FIGS. 2-3 depict a related art lighting fixture configured to accommodate a series of LED bulbs. The related art lighting fixture includes a support structure 104 having a series of lamp arms 105, lamp cups 106 supported on the ends of the lamp arms 105, lamp holders 107, lampshades 108, and spiral pressure rings 109. The lamp holders 107 include external threads configured to be threadedly engaged by the spiral pressure rings 109. The bottom of each lampshade 108 includes a through-hole 110. To install the related art LED bulbs in the related art lighting fixture, the lamp holder 107 must be inserted through the through-hole 110 in the bottom of the lampshade 108 and supported on the lamp cup 106. The lamp holder 107 may then be secured to the lamp cup 106 by threading the spiral pressure ring 109 onto the lamp holder 107 until the spiral pressure ring 109 engages the bottom of the lampshade 108. Once the lamp holder 107 is secured to the lamp cup 106 by the pressure ring, the LED bulb may be threaded into the lamp holder 107. Accordingly, related art lighting fixtures require several components to install the related art LED bulbs, which makes installation of the related art LED bulbs cumbersome and time consuming and increases the cost of the lighting fixture.

Additionally, related art LED light bulbs are large and, as illustrated in FIGS. 2-3, occupy most of the space inside the lampshade 108. Moreover, due to the large size of the related art LED light bulbs, the one or more LEDs housed in the heat sink casing 102 are spaced far apart from the bottom of the lampshade 108. Accordingly, light emitted from the one or more LEDs in the LED light bulb is obstructed by the bottom of the lampshade 108, which creates dark shade areas and shadows. The presence of dark shade areas and shadows create a poor visual effect rendering the related art LED light bulbs unsuitable for many applications, such as decorative lighting applications.

SUMMARY

The present disclosure is directed to various embodiments of an LED light bulb. In one embodiment, the LED light bulb includes a heat sink including a base and series of cooling fins arranged around the base. The cooling fins define external threads. The LED light bulb also includes an LED light board on an upper end of the heat sink. The LED light board includes at least one LED light. The LED light bulb also includes a pressure ring on the upper end of the heat sink surrounding the LED light board, and a translucent cover configured to cover the LED light board. The translucent cover includes a cover body and a series of hooks extending from the cover body. Each hook includes a resilient arm including a proximal end at a lower edge of the cover body and a free distal edge opposite the proximal end and an elastic arm extending inward from the free distal end of the resilient arm. When the translucent cover is connected to the pressure ring, the lower edge of the cover body is pressed against an upper surface of the pressure ring and the elastic arm of each of the plurality of hooks is pressed against a lower surface of the pressure ring.

The LED light board may include a substrate, and the at least one LED light may include a series of LED lights on the substrate.

The LED light bulb may include at least one fastener configured to couple the pressure ring to the upper end of the heat sink. When the pressure ring is coupled to the upper end of the heat sink by the fastener, the pressure ring presses the substrate of the LED light board against the upper end of the heat sink.

The at least one fastener may not extend through the LED light board.

The pressure ring may overlap a portion of the substrate of the LED light board when the pressure ring is coupled to the upper end of the heat sink by the fastener.

The lower edge of the cover body may define at least one recess configured to accommodate a head of the at least one fastener.

The upper end of the heat sink may define a series of recesses configured to receive the elastic arms of the hooks.

The heat sink may be cylindrical and the external threads defined by the cooling fins may extend from a lower end of the heat sink to the upper end of the heat sink.

An LED light bulb according to another embodiment of the present disclosure includes a heat sink includes a base and series of cooling fins arranged around the base defining external threads, an LED light board on an upper end of the heat sink including at least one LED light, a pressure ring on the upper end of the heat sink surrounding the LED light board, a translucent cover configured to cover the LED light board, and a bottom case assembly coupled to a lower end of the heat sink opposite to the upper end of the heat sink. The bottom case assembly includes a case body including a level projection recessed below an upper end of the case body, and a power driver module electrically coupled to the LED light board. The power driver module includes a circuit board supported on the leveling projection.

The bottom case assembly may include a cover coupled to a bottom end of the case body.

The case body of the bottom case assembly may define a step at the bottom end of the case body, and the cover may engage the step.

The LED light bulb may include external power supply wires electrically coupled to the circuit board of the power driver module.

The cover may define a central opening, and the external power supply wires may extend through the central opening in the cover.

The LED light bulb may also include a bracket coupled to the cover and the case body, and the bracket may be configured to couple the LED light bulb to a lighting fixture.

The bracket may define an internally threaded central opening.

The LED light bulb may include a series of fasteners coupling the bracket to the bottom case assembly and coupling the bottom case assembly to the lower end of the heat sink.

The case body may be hollow and may define an upper opening at the upper end of the case body and a lower opening at the bottom end of the hollow case body. The circuit board of the power driver module may be received in the upper opening of the case body, and the cover may be received in the lower opening of the case body.

The translucent cover may include a cover body and a series of hooks extending from the cover body. Each hook may include a resilient arm including a proximal end at a lower edge of the cover body and a free distal edge opposite the proximal end and an elastic arm extending inward from the free distal end of the resilient arm.

This summary is provided to introduce a selection of features and concepts of embodiments of the present disclosure that are further described below in the detailed description. This summary is not intended to identify key or essential features of the claimed subject matter, nor is it intended to be used in limiting the scope of the claimed subject matter. One or more of the described features may be combined with one or more other described features to provide a workable device.

BRIEF DESCRIPTION OF THE DRAWINGS

These and other features and advantages of embodiments of the present disclosure will become more apparent by reference to the following detailed description when considered in conjunction with the following drawings. In the drawings, like reference numerals are used throughout the figures to reference like features and components. The figures are not necessarily drawn to scale.

DETAILED DESCRIPTION

Figure 1:
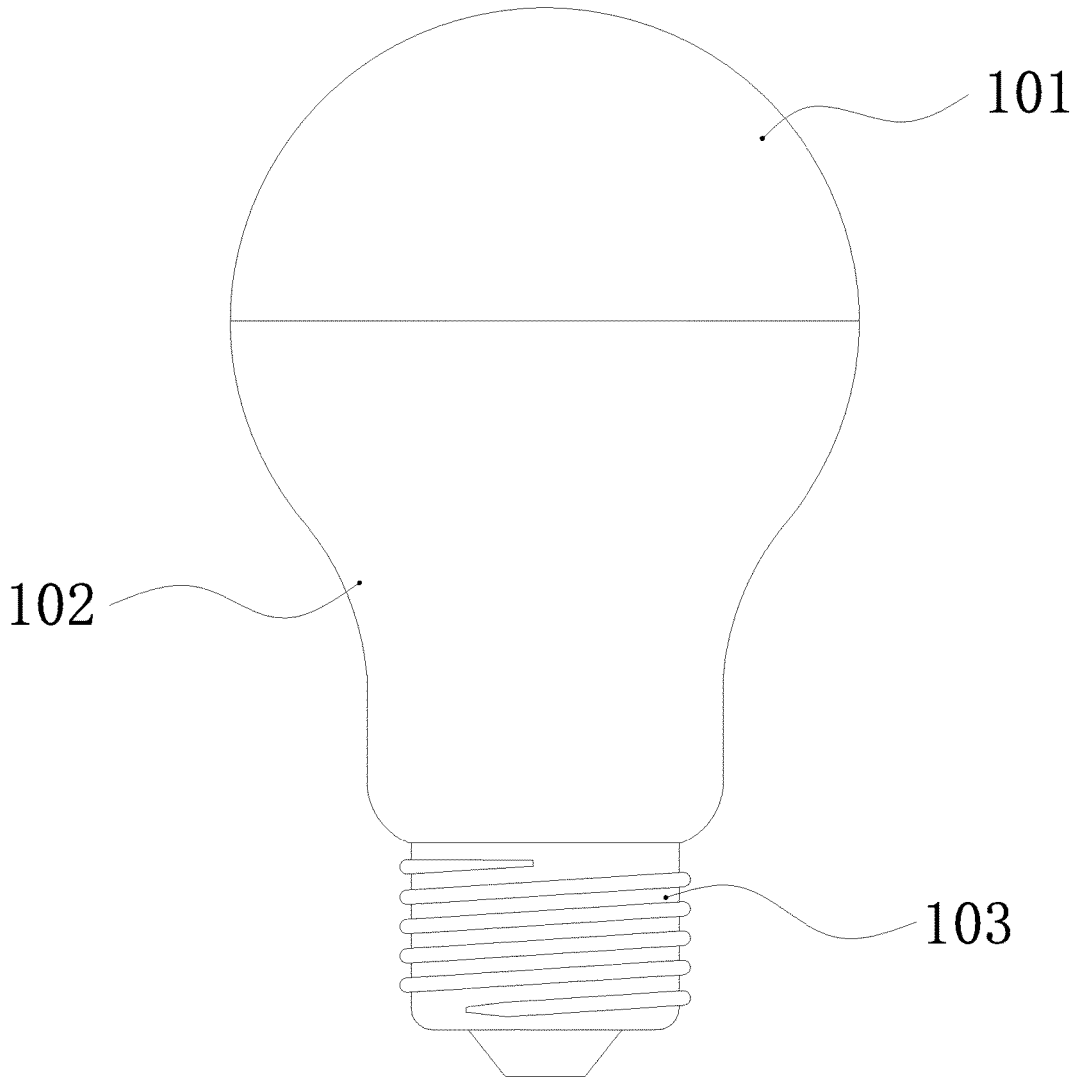
FIG. 1 Related Art
FIG. 1 is a schematic view of a related art LED light bulb.
Figure 2:
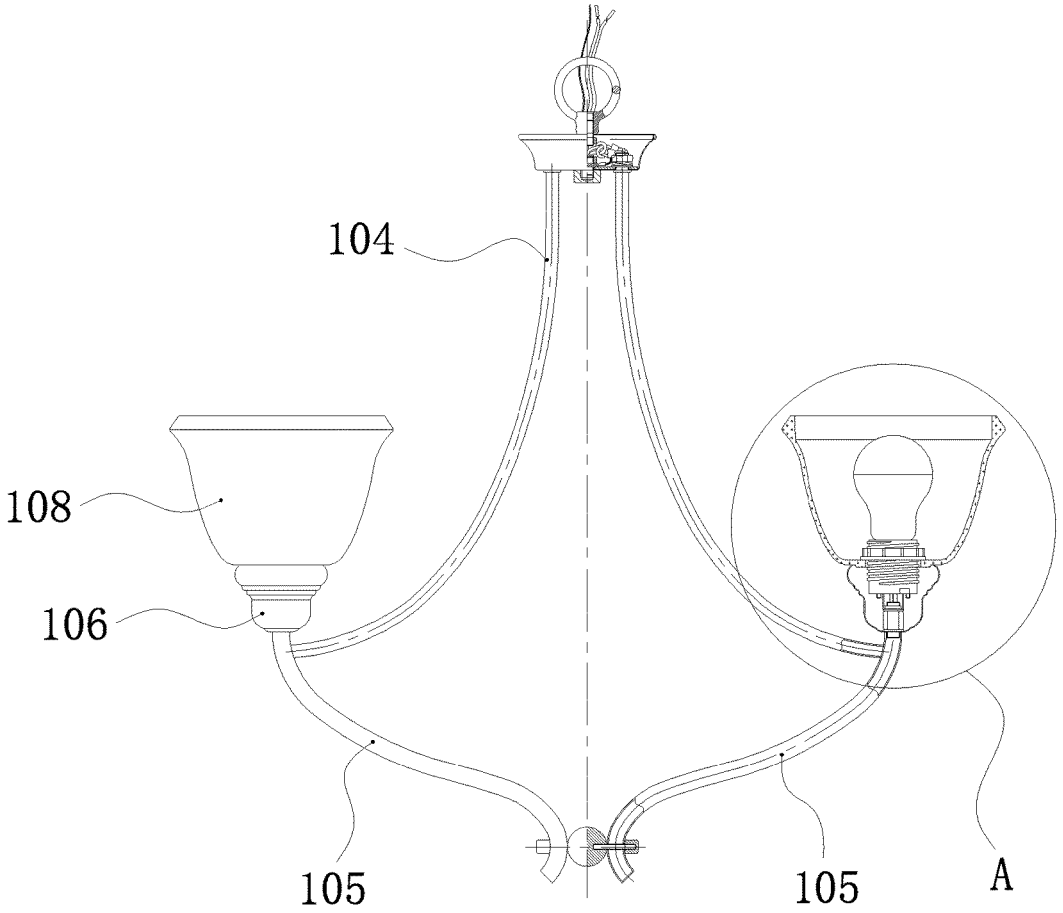
FIG. 2 Related Art
FIG. 2 is a schematic view of a lamp incorporating the related art LED bulbs illustrated in FIG. 1.
Figure 3:
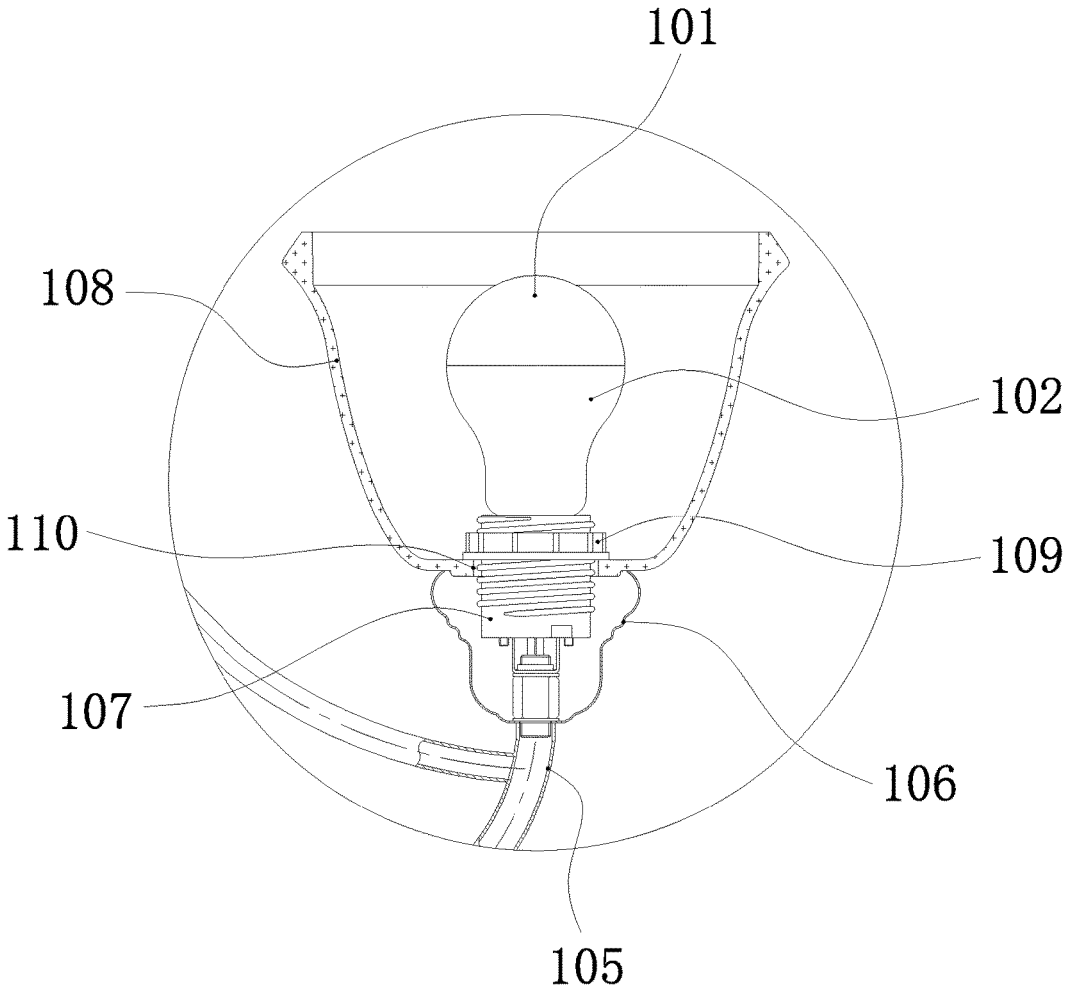
FIG. 3 Related Art
FIG. 3 is an enlarged view of portion A of FIG. 2.
Figure 4:
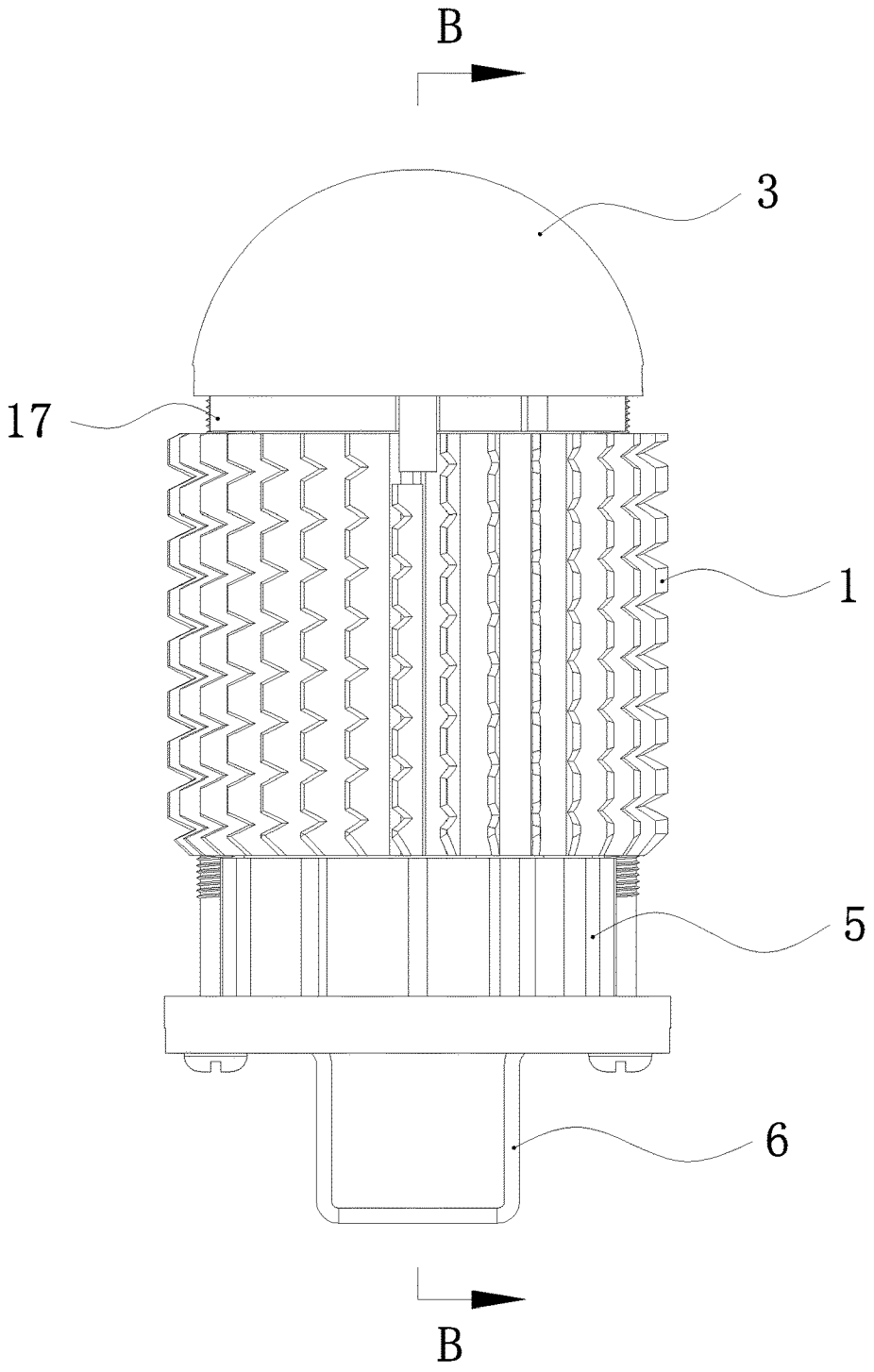
FIG. 4 is a side view of an LED light bulb according to one embodiment of the present disclosure.
Figures 5A, 5B:
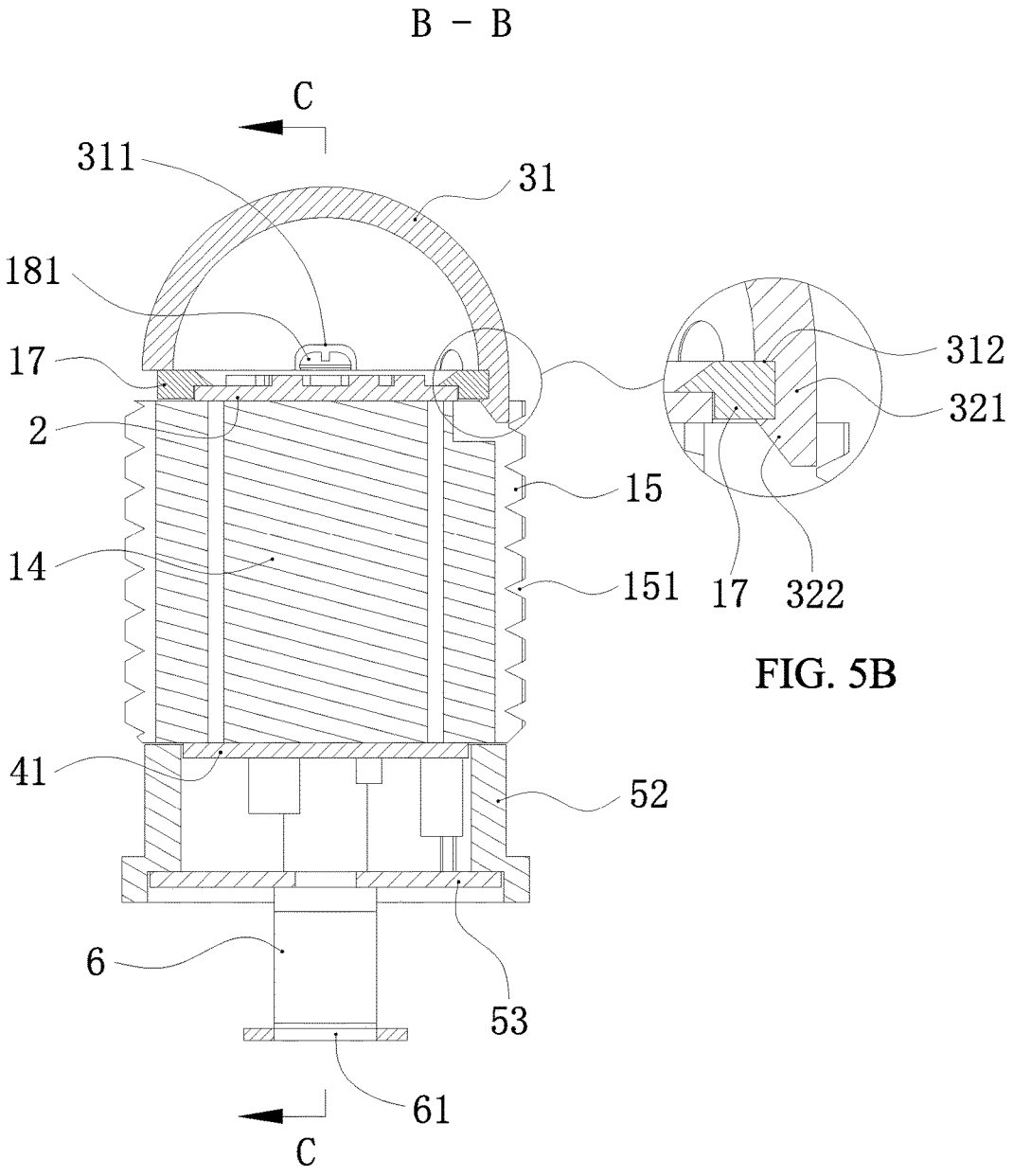
FIGS. 5A-5B are a cross-sectional view and an enlarged portion view, respectively, of the embodiment of the LED light bulb illustrated in FIG. 4.
Figure 6:
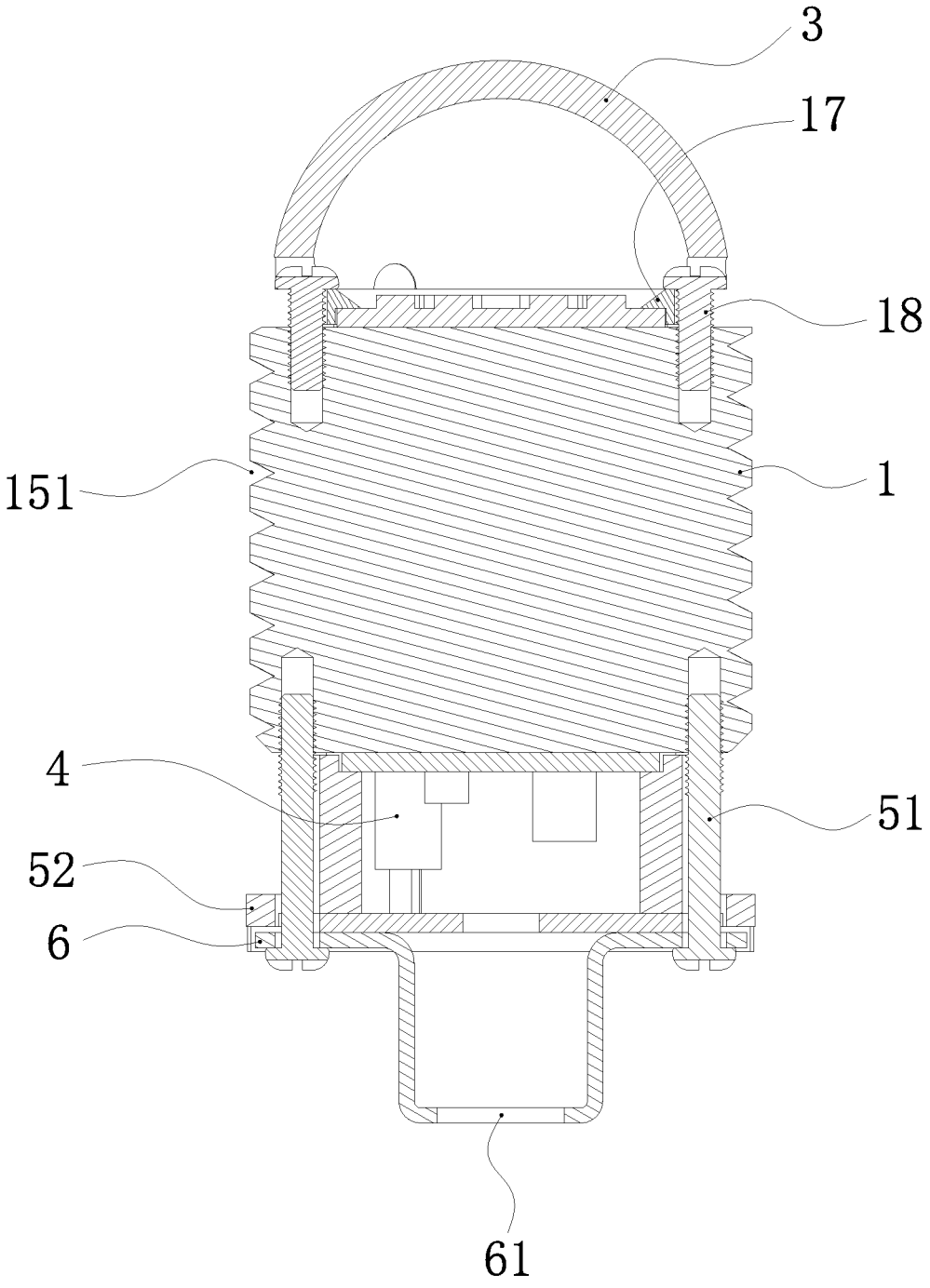
FIG. 6 is a cross-sectional view of the embodiment of the LED light bulb illustrated in FIG. 5A taken along line C-C.

The present disclosure is directed to various embodiments of a light emitting diode (LED) light bulb. Embodiments of the LED light bulbs of the present disclosure are configured to improve the visual effect and/or reduce the installation time of the LED light bulbs compared to related art LED light bulbs. Embodiments of the LED light bulbs of the present disclosure are also configured to reduce the number of components required to install the LED light bulbs in a lighting fixture compared to related art LED light bulbs.

With reference now to FIGS. 4-9, an LED light bulb according to one embodiment of the present disclosure includes a heat sink 1 (e.g., a radiator), an LED light board 2, a translucent cover 3, and a power driver module 4 electrically coupled to the LED light board 2. The LED light board 2 includes a substrate 21 and one or more LED lights 22 on the substrate 21. The substrate 21 may be any suitable material, such as, for instance, aluminum or copper. In the illustrated embodiment, the translucent cover 3 and the LED light board 2 are mounted on an upper mounting surface 16 on an upper end 11 of the heat sink 1.

In the illustrated embodiment, the LED light bulb also includes a pressure ring 17 and at least one fastener 18 coupling the pressure ring 17 to the heat sink 1. Additionally, when the pressure ring 17 is coupled to the heat sink 1, the pressure ring 17 and the substrate 21 of the LED light board 2 are pressed against the upper mounting surface 16 of the heat sink 1. Additionally, when the pressure ring 17 is coupled to the heat sink 1 by the one or more fasteners 18, threaded shanks of the one or more fasteners 18 is screwed into the pressure ring 17 and the heat sink 1 and heads of the one or more fasteners 18 are pressed against the pressure ring 17. Although in the illustrated embodiment the LED light bulb includes two fasteners 18 coupling the pressure ring 17 and the circuit board 2 to the heat sink 1, in one or more embodiments, the LED light bulb may include any other suitable number of fasteners 18, such as, for instance, one fastener 18 or more than two fasteners 18.

With continued reference to the embodiment illustrated in FIGS. 4-9, the translucent cover 3 includes a cover body 31 and a series of hooks 32 arranged circumferentially around a lower edge 312 of the cover body 31. In the illustrated embodiment, each of the hooks 32 includes a resilient arm 321 extending down from the lower edge 312 of the cover body 31. The resilient arms 321 each include a proximal end at the lower edge 312 of the cover body 31 and a free distal edge opposite the proximal end. In the illustrated embodiment, each of the hooks 32 also includes an elastic arm 322 extending inward from the free distal ends of the resilient arms 321 towards a center of the translucent cover 3. Although in the illustrated embodiment the translucent cover 3 includes three hooks 32 equidistantly arranged around the lower edge 312 of the cover body 31, in one or more alternate embodiments, the translucent cover 3 may include any other suitable number of hooks 32 and the hooks 32 may have any other suitable arrangement. When the translucent cover 3 is coupled to the pressure ring 17, the elastic arms 322 of the hooks 32 are pressed against a bottom surface of the pressure ring 17 and the lower edge 312 of the cover body 31 is pressed against an upper surface of the pressure ring 17 (e.g., the pressure ring 17 is sandwiched between the lower edge 312 of the cover body 31 and the elastic arms 322 of the hooks 32). Additionally, in the illustrated embodiment, the resilient arms 321 of the hooks 32 extend into recesses 19 in the upper end 11 of the heat sink 1. In the illustrated embodiment, the translucent cover 3 also includes recesses 311 in the lower edge 312 of the cover body 31 to accommodate heads 181 of the fasteners 18 coupling the pressure ring 17 to the heat sink 1.

The cover body 31 of the translucent cover 3 may include any suitable translucent material. In one or more embodiments, the cover body 31 of the translucent cover 3 may include one or more features configured to refract and/or reflect light passing through the cover body 31, such as, for instance, to increase the emission angle of the light emitted from the translucent cover 3 and/or to reduce the presence of undesirable lighting effects (e.g., light and dark spots). Suitable features for refracting and/or reflecting light are described in U.S. patent application Ser. No. 14/997,175, filed Jan. 15, 2016 and entitled "LED Covers and LED Light Bulbs Incorporating the Same," the entire contents of which are incorporated herein by reference.

Additionally, in the illustrated embodiment, the LED light bulb includes a bottom case assembly 5. The bottom case assembly 5 includes the power driver module 4, a cartridge or case body 52, and a cover 53. In the illustrated embodiment, the bottom case assembly 5 is coupled to a lower end 12 of the heat sink 1. Additionally, in the illustrated embodiment, the power driver module 4 is provided at an upper end of the case body 52 and the cover 53 is provided at a lower end of the case body 52.

With continued reference to the embodiment illustrated in FIGS. 4-9, the LED light bulb includes a bracket 6 coupled to a lower end of the bottom case assembly 5. The bracket 6 defines a central opening 61 (e.g., an internally threaded center hole) configured to receive a fastener coupling the LED light bulb to a lighting fixture (see FIGS. 11-12). Additionally, in the illustrated embodiment, the LED light bulb includes at least one fastener (e.g., at least one screw) 51 coupling the bottom case assembly 5 to the lower end 12 of the heat sink 1 and coupling the bracket 6 to the bottom case assembly 5. In the illustrated embodiment, the threaded shank of the fastener 51 extends up through an opening in the bracket 6, through openings in the bottom case assembly 5 (e.g., openings in the cover 53, the case body 52, and/or the power driver module 4), and is threadedly coupled to the heat sink 1. Additionally, the head of the fastener 51 is pressed against the bracket 6. Accordingly, the one or more fasteners 51 lock the bracket 6 and the case body 52 to the lower end 12 of the heat sink 1. Although in the illustrated embodiment the LED light bulb includes two fasteners 51, in one or more alternate embodiments, the LED light bulb may include any other suitable number of fasteners, such as, for instance, a single fastener or more than two fasteners.

Figure 7:
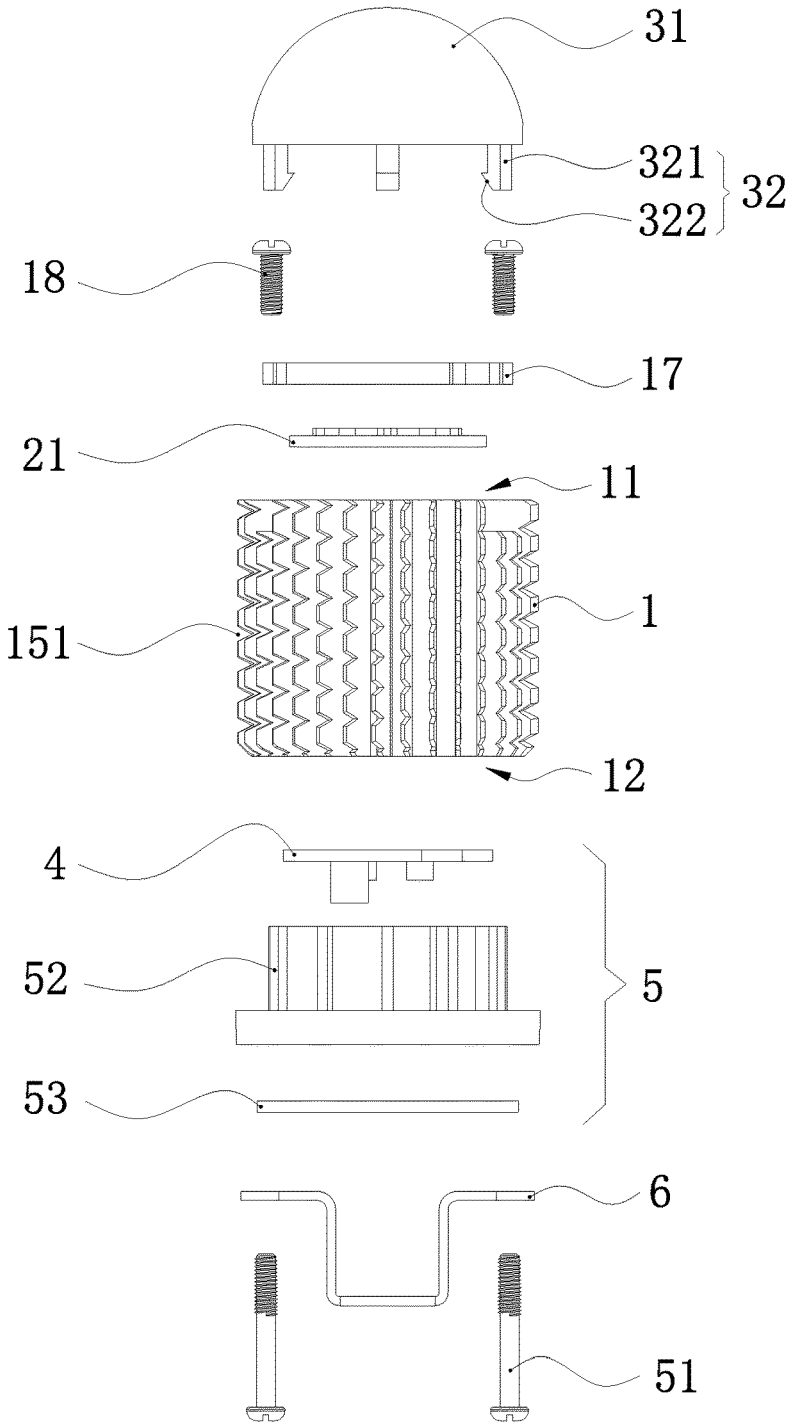
FIG. 7 is an exploded view of the embodiment of the LED light bulb illustrated in FIG. 1.
Figure 8:
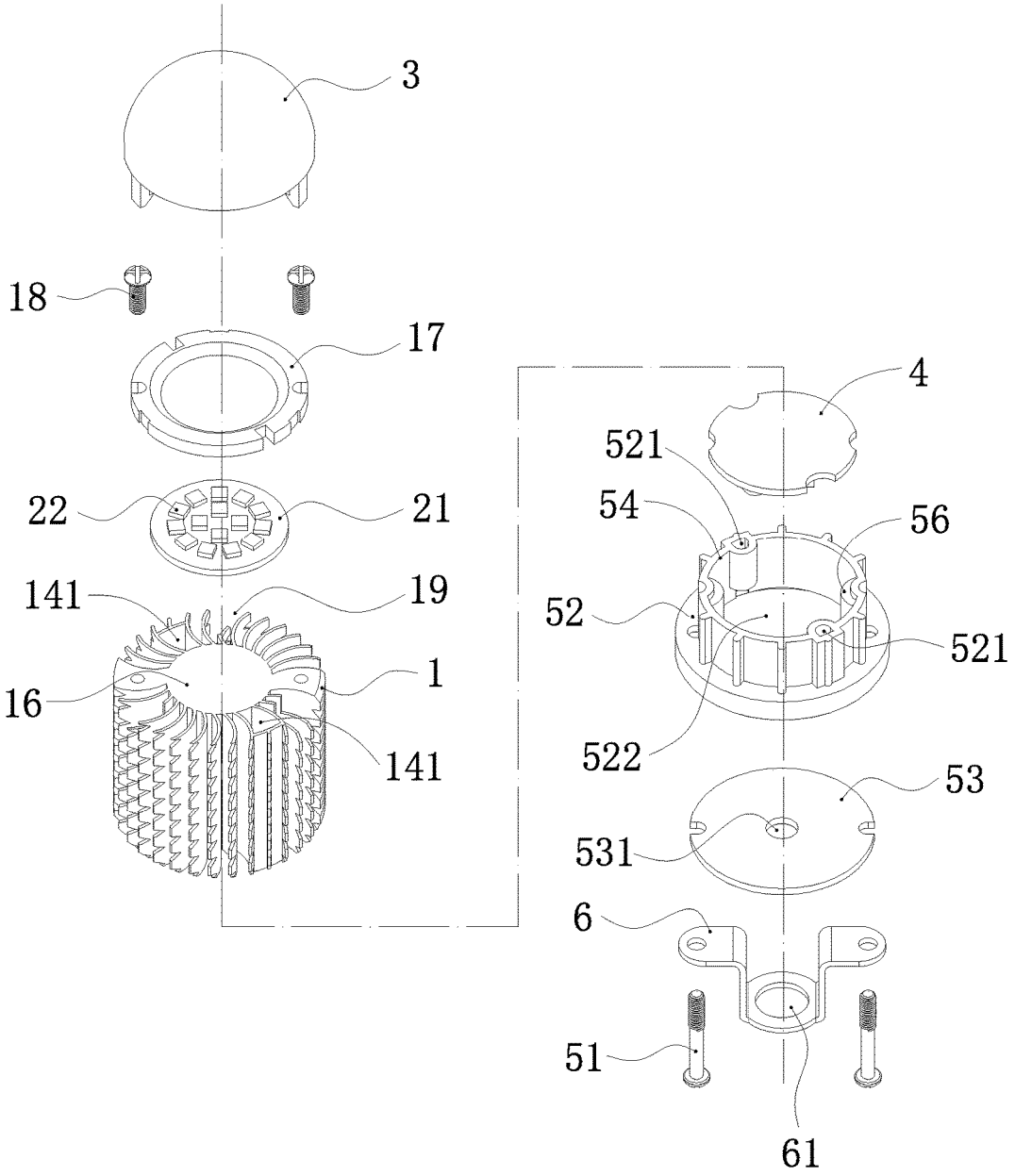
FIG. 8 is an exploded view of the embodiment of the LED light bulb illustrated in FIG. 1.
Figure 9:
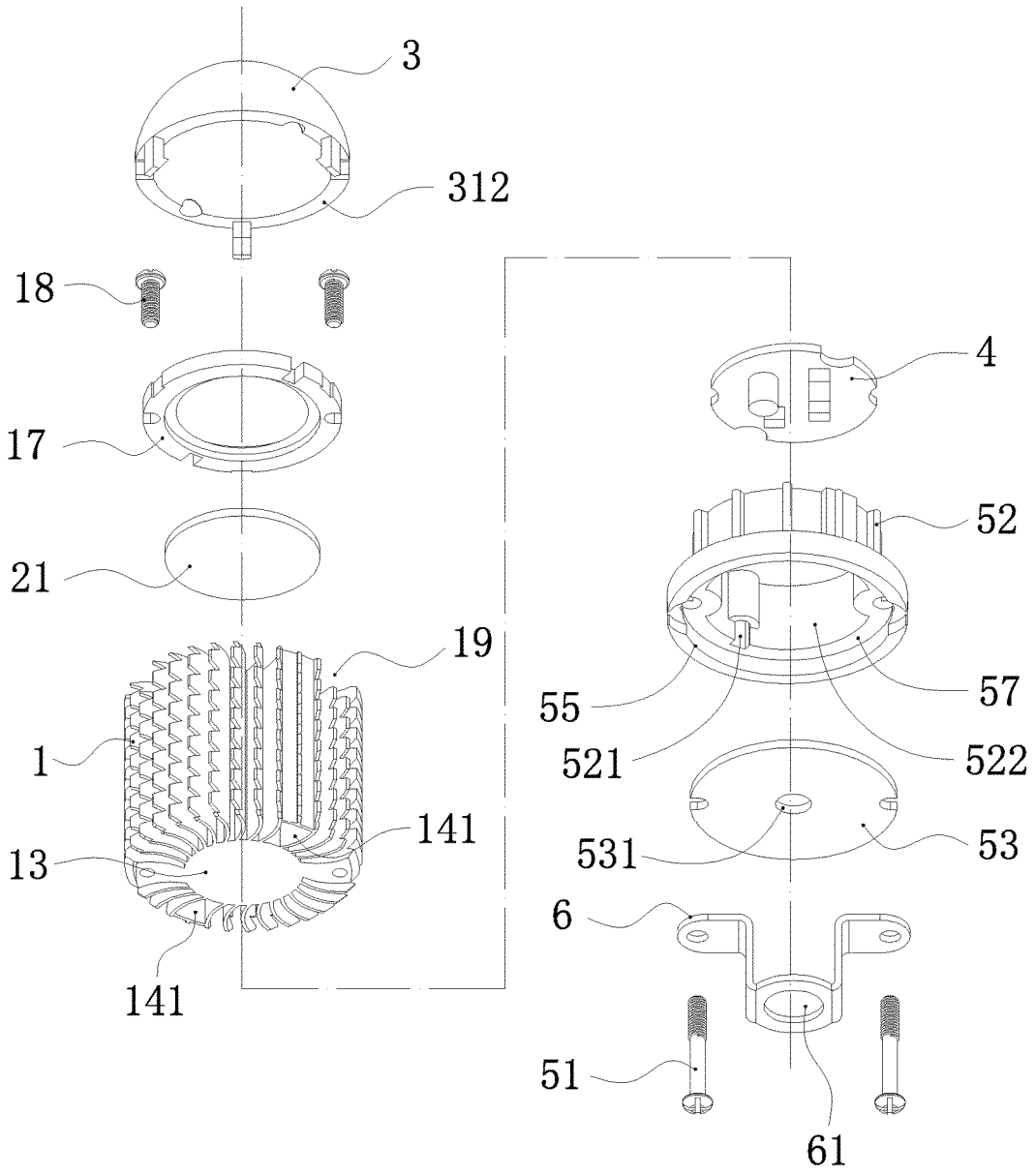
FIG. 9 is an exploded view of the embodiment of the LED light bulb illustrated in FIG. 1.

With reference now to the embodiment illustrated in FIGS. 7-9, the case body 52 includes a hollow body 522 and defines an upper opening 54 at the top of the case body 52 and a lower opening 55 defined in the bottom of the case body 52. The top of the case body 52 refers to the end of the case body 52 proximal the bottom end 12 of the heat sink 1 and the bottom of the case body 52 refers to the end of the case body 52 distal the bottom end 12 of the heat sink 1. Additionally, in the illustrated embodiment, the case body 52 includes at least one leveling projection 56 extending inward from the hollow body 522 and toward a center of the case body 52. The at least one leveling projection 56 is recessed below the top end of the case body 52. In the illustrated embodiment, the bottom end of the case body 52 also defines a step 57.

In the illustrated embodiment, the power drive module 4 includes a circuit board 41. The circuit board 41 is at least partially received in the upper opening 54 in the case body 52 (e.g., the circuit board 41 extends into the upper opening 54 in the case body 52). Additionally, the circuit board 41 is supported on the leveling projections 56 of the case body 52. The circuit board 41 also engages a lower mounting surface 13 of the heat sink 1. Accordingly, the circuit board 41 is between the lower mounting surface 13 at the bottom end 12 of the heat sink 1 and the leveling projections 56 of the case body 52.

The cover 53 of the bottom case assembly 5 is at least partially received in the lower opening 55 in the bottom of the case body 52 (e.g., the cover 53 extends into the lower opening 55 in the case body 52). Additionally, in the illustrated embodiment, the cover 53 engages the step 57 in the case body 52. Accordingly, the cover 53 is between the bracket 6 and the step 57 of the case body 52.

Still referring to the embodiment illustrated in FIGS. 7-9, the heat sink 1 includes a cylindrical base or substrate 14 and a series of cooling fins 15 arranged circumferentially around the cylindrical base 14. Although in the illustrated embodiment the base 14 of the heat sink 1 is solid, in one or more alternate embodiments the base 14 may be hollow. In the illustrated embodiment, the cooling fins 15 are uniformly or substantially uniformly arranged around a longitudinal axis of the heat sink 1. Additionally, in the illustrated embodiment, the cooling fins 15 define external threads 151. The external threads 151 may be formed in the cooling fins 15 by any suitable manufacturing process or technique, such as, for instance, machining. In the illustrated embodiment, the cooling fins 15 and the external threads 151 defined by the cooling fins 15 extend from the lower end 12 to the upper end 11 of the heat sink 1. The external threads 151 are configured to facilitate coupling the LED light bulb to a lighting fixture, such as with a compression ring 10 engaging the external threads 151, as described in more detail below with reference to FIGS. 10-12.

Figure 14:
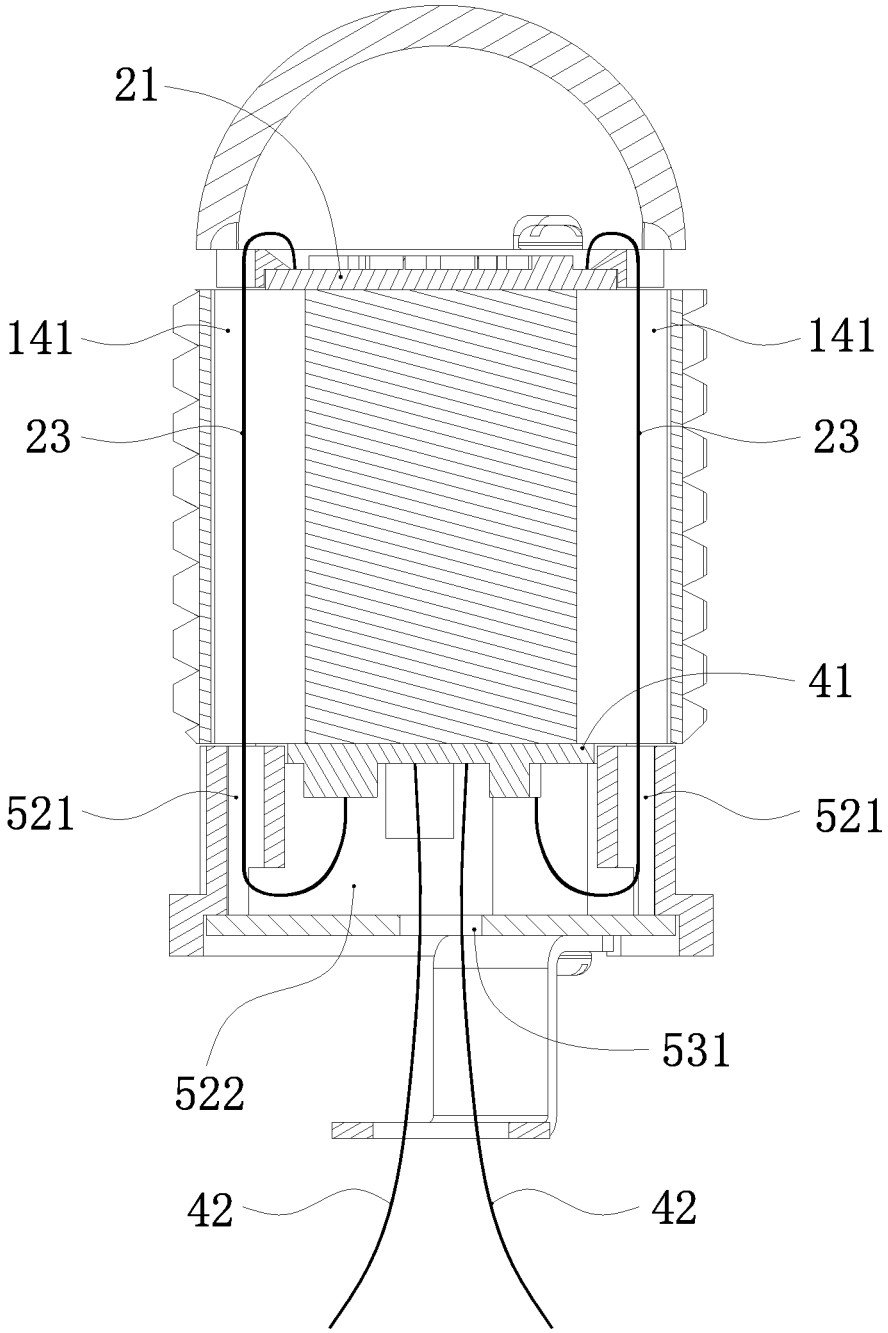
FIG. 14 is a cross-sectional view of the embodiment of the LED light bulb illustrated in FIG. 13 taken along line E-E.

In the embodiment illustrated in FIGS. 7-9, the heat sink 1 includes a pair of diametrically opposed channels or conduits 141 extending longitudinally from the upper end 11 to the lower end 12 of the heat sink 1. Similarly, the hollow body 522 of the case body 52 includes a pair of diametrically opposed channels or conduits 521 aligned with the channels or conduits 141 in the heat sink 1. The conduits 521 in the case body 52 are in communication with the conduits 141 in the heat sink 1. As illustrated in FIG. 14, two electrical wires 23 extend from the circuit board 41 of the power driver module 4, up through the conduits 521, 141 in the case body 52 and the heat sink 1, respectively, and are coupled to the substrate 21 of the LED light board 2. In one or more embodiments, the heat sink 1 and the case body 52 may include any other suitable number of conduits 141, 521 and the conduits 141, 521 may have any other suitable arrangement on the heat sink 1 and the case body 52, respectively, depending, for instance, on the number of electrical wires extending between the circuit board 41 and the substrate 21.

Additionally, in the embodiment illustrated in FIG. 14, the cover 53 of the bottom case assembly 5 defines a central opening 531. External power supply wires 42 extend from the circuit board 41 of the power driver module 4, down through the hollow body 522 of the case body 52, out through the central openings 531, 61 in the cover 53 and the bracket 6, respectively. The external power supply wires 42 are configured to be coupled to an external power supply.

Figure 10:
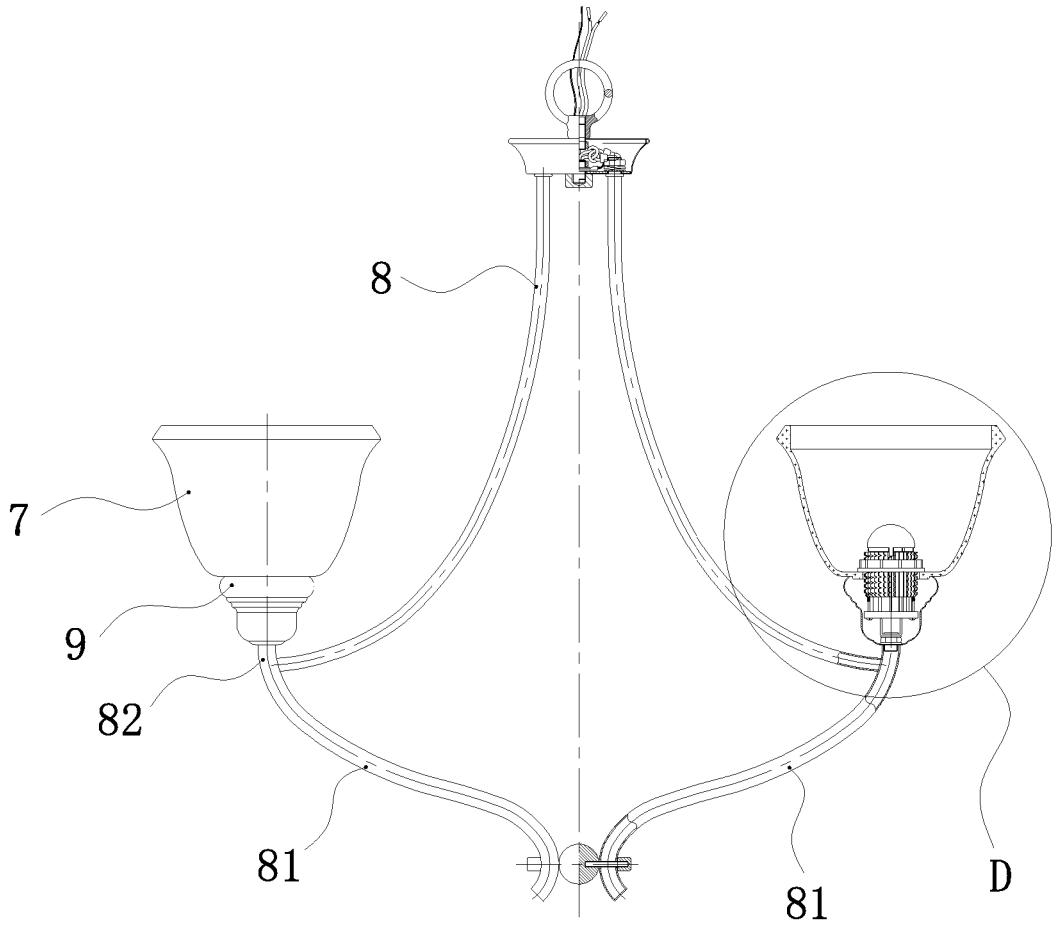
FIG. 10 is a schematic view of a lamp incorporating the embodiment of the LED light bulb illustrated in FIG. 1.
Figure 11:
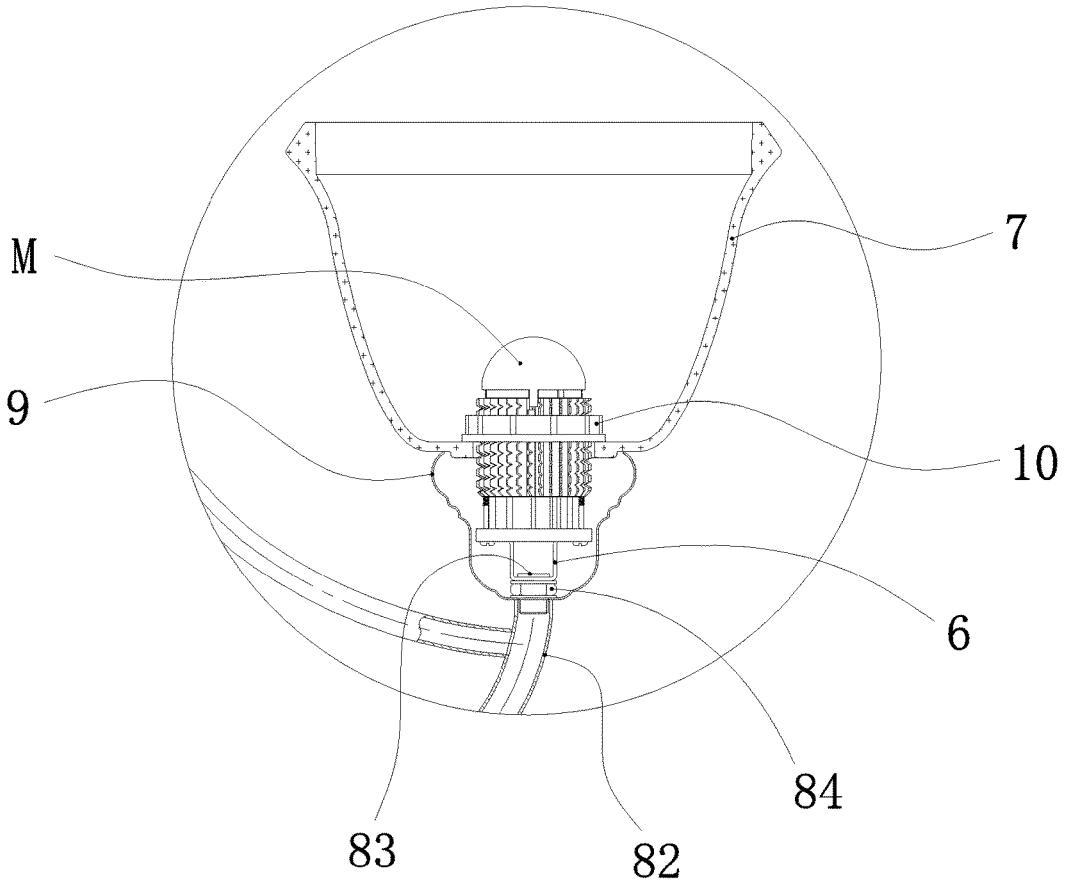
FIG. 11 is an enlarged view of portion D of FIG. 10.
Figure 12:
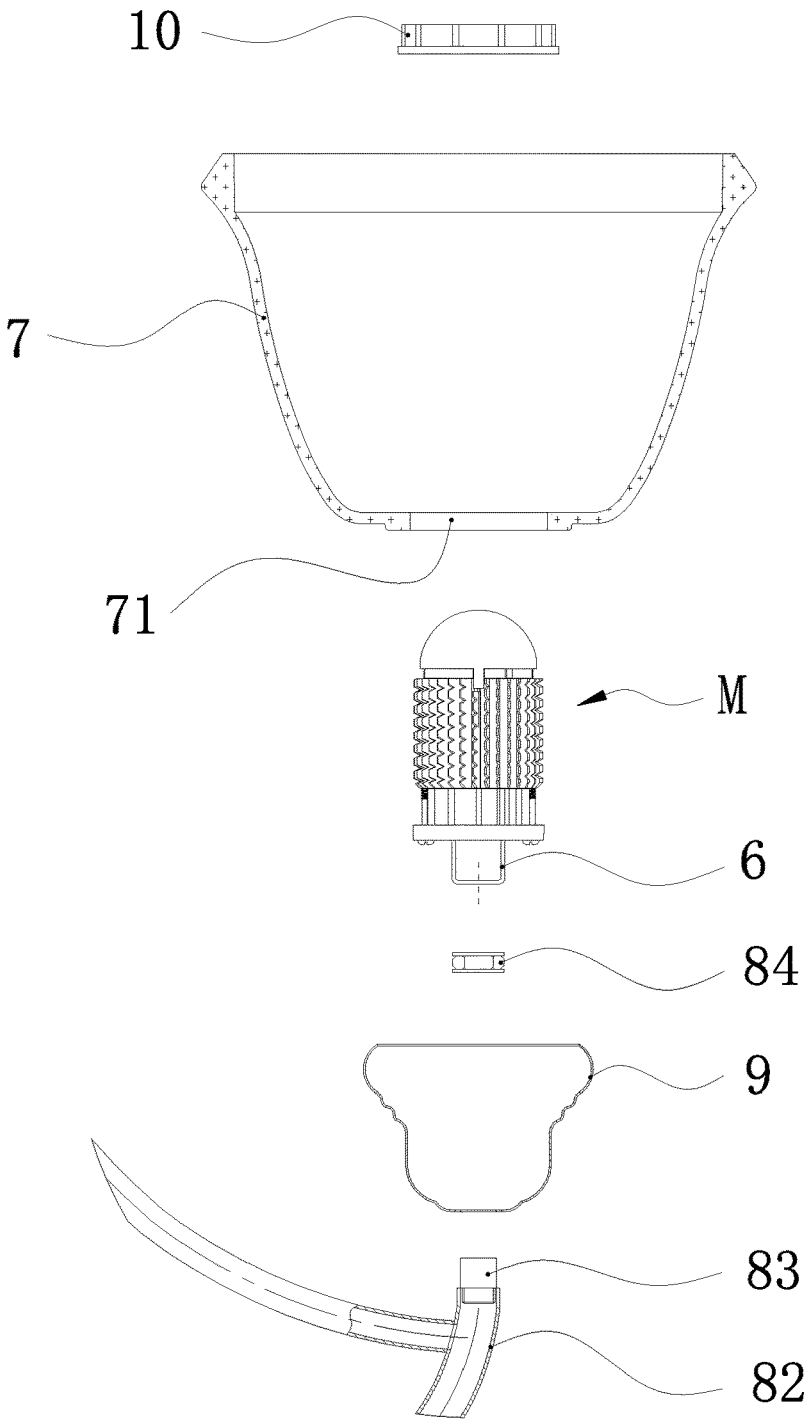
FIG. 12 is an exploded view of the components illustrated in FIG. 11.
Figure 13:
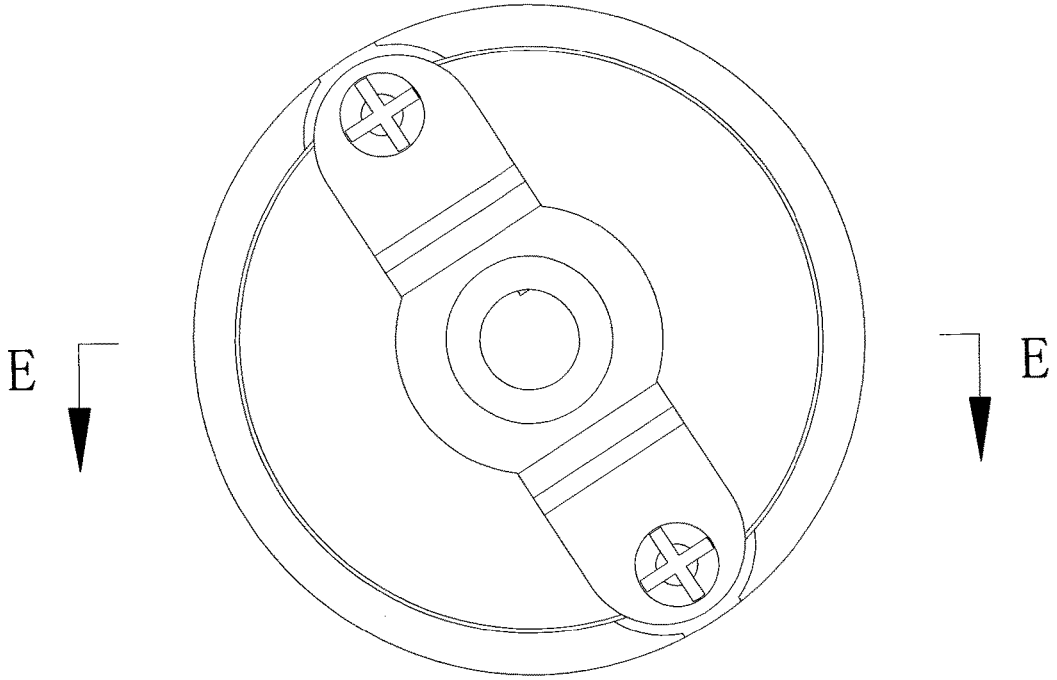
FIG. 13 is a bottom view of the embodiment of the LED light bulb illustrated in FIG. 1.

FIGS. 10 and 11 depict the embodiment of the LED light bulb M illustrated in FIGS. 4-9 installed in a light fixture. In the illustrated embodiment, the light fixture includes a support structure 8 having a series of arms 81, a series of lamp cup shells 9 coupled to the arms 81 of the support structure 8, and a series of lampshades 7 coupled to each of the lamp cup shells 9. As illustrated in FIG. 11, the lighting fixture includes a stud 83 and a locking nut 84 at an end 82 of each arm 81. In the illustrated embodiment, the stud 83 extends down through the central opening 61 in the bracket 6 and the locking nut 84 engages the stud 83 to couple the bracket 6 of the LED light bulb to the ends 82 of the arms 81 of the lighting fixture.

In the illustrated embodiment, a bottom end of each of the lampshades 7 is supported on the lamp cup shells 9. Additionally, each lampshade 7 includes an opening 71. A portion of the LED light bulb M extends up from the lamp cup shell 9 and through the opening 71 in the lampshade 7. The LED light bulb M may be coupled to the lampshade 7 and the lamp cup shell 9 by threading the compression ring 10 onto the external threads 151 defined in the cooling fins 15. In the illustrated embodiment, when the compression ring 10 is fully threaded onto the external threads 151 of the LED light bulb M, the compression ring 10 contacts the bottom end of the lampshade 7.

While this invention has been described in detail with particular references to exemplary embodiments thereof, the exemplary embodiments described herein are not intended to be exhaustive or to limit the scope of the invention to the exact forms disclosed. Persons skilled in the art and technology to which this invention pertains will appreciate that alterations and changes in the described structures and methods of assembly and operation can be practiced without meaningfully departing from the principles, spirit, and scope of this invention, as set forth in the following claims. Although relative terms such as "outer," "inner," "upper," "lower," and similar terms have been used herein to describe a spatial relationship of one element to another, it is understood that these terms are intended to encompass different orientations of the various elements and components of the invention in addition to the orientation depicted in the figures. Additionally, as used herein, the term "substantially" and similar terms are used as terms of approximation and not as terms of degree, and are intended to account for the inherent deviations in measured or calculated values that would be recognized by those of ordinary skill in the art. Furthermore, as used herein, when a component is referred to as being "on" another component, it can be directly on the other component or components may also be present therebetween. Moreover, when a component is referred to as being "coupled" to another component, it can be directly attached to the other component or intervening components may be present therebetween.

What is claimed is:

1. An LED light bulb comprising:

a heat sink comprising a base and plurality of cooling fins arranged around the base, the cooling fins defining external threads;

an LED light board on an upper end of the heat sink, the LED light board comprising at least one LED light;

a pressure ring on the upper end of the heat sink, the pressure ring surrounding the LED light board; and a translucent cover configured to cover the LED light board, the translucent cover comprising:

a cover body; and a plurality of hooks extending from the cover body, each hook comprising a resilient arm including a proximal end at a lower edge of the cover body and a free distal edge opposite the proximal end and an elastic arm extending inward from the free distal end of the resilient arm, wherein, when the translucent cover is connected to the pressure ring, the lower edge of the cover body is pressed against an upper surface of the pressure ring and the elastic arm of each of the plurality of hooks is pressed against a lower surface of the pressure ring.

2. The LED light bulb of claim 1, wherein the LED light board comprises a substrate, and wherein the at least one LED light comprises a plurality of LED lights on the substrate.

3. The LED light bulb of claim 2, further comprising at least one fastener configured to couple the pressure ring to the upper end of the heat sink, and wherein, when the pressure ring is coupled to the upper end of the heat sink by the fastener, the pressure ring presses the substrate of the LED light board against the upper end of the heat sink.

4. The LED light bulb of claim 3, wherein the at least one fastener does not extend through the LED light board.

5. The LED light bulb of claim 3, wherein the pressure ring overlaps a portion of the substrate of the LED light board when the pressure ring is coupled to the upper end of the heat sink by the fastener.

6. The LED light bulb of claim 3, wherein the lower edge of the cover body defines at least one recess, the at least one recess configured to accommodate a head of the at least one fastener.

7. The LED light bulb of claim 1, wherein the upper end of the heat sink defines a plurality of recesses, and wherein each recess of the plurality of recesses is configured to receive the elastic arm of a hook of the plurality of hooks.

8. The LED light bulb of claim 1, wherein the heat sink is cylindrical and the external threads defined by the cooling fins extend from a lower end of the heat sink to the upper end of the heat sink.

9. An LED light bulb comprising:

a heat sink comprising a base and plurality of cooling fins arranged around the base, the cooling fins defining external threads;

an LED light board on an upper end of the heat sink, the LED light board comprising at least one LED light;

a pressure ring on the upper end of the heat sink, the pressure ring surrounding the LED light board;

a translucent cover configured to cover the LED light board; and a bottom case assembly coupled to a lower end of the heat sink opposite to the upper end of the heat sink, the bottom case assembly comprising:

a case body comprising a level projection recessed below an upper end of the case body;

a power driver module electrically coupled to the LED light board, the power driver module comprising a circuit board supported on the leveling projection; and a cover coupled to a bottom end of the case body, the cover defining a central opening; and external power supply wires electrically coupled to the circuit board of the power driver module, wherein the external power supply wires extend through the central opening in the cover.

10. The LED light bulb of claim 9, wherein the case body of the bottom case assembly defines a step at the bottom end of the case body, and wherein the cover engages the step.

11. The LED light bulb of claim 9, further comprising a bracket coupled to the cover and the case body, wherein the bracket is configured to couple the LED light bulb to a lighting fixture.

12. The LED bulb of claim 9, wherein:

the case body is hollow and defines an upper opening at the upper end of the case body and a lower opening at the bottom end of the hollow case body, the circuit board of the power driver module is received in the upper opening of the case body, and the cover is received in the lower opening of the case body.

13. The LED bulb of claim 9, wherein the translucent cover comprises:

a cover body; and a plurality of hooks extending from the cover body, each hook comprising a resilient arm including a proximal end at a lower edge of the cover body and a free distal edge opposite the proximal end and an elastic arm extending inward from the free distal end of the resilient arm.

14. An LED light bulb comprising:

a heat sink comprising a base and plurality of cooling fins arranged around the base, the cooling fins defining external threads;

an LED light board on an upper end of the heat sink, the LED light board comprising at least one LED light;

a pressure ring on the upper end of the heat sink, the pressure ring surrounding the LED light board;

a translucent cover configured to cover the LED light board;

a bottom case assembly coupled to a lower end of the heat sink opposite to the upper end of the heat sink, the bottom case assembly comprising:

a case body comprising a level projection recessed below an upper end of the case body;

a power driver module electrically coupled to the LED light board, the power driver module comprising a circuit board supported on the leveling projection;

a cover coupled to a bottom end of the case body;

a bracket coupled to the cover and the case body, wherein the bracket is configured to couple the LED light bulb to a lighting fixture, and wherein the bracket defines an internally threaded central opening.

15. The LED light bulb of claim 14, further comprising external power supply wires electrically coupled to the circuit board of the power driver module.

16. The LED light bulb of claim 15, wherein the cover defines a central opening, and wherein the external power supply wires extend through the central opening in the cover.

17. An LED light bulb comprising:

a heat sink comprising a base and plurality of cooling fins arranged around the base, the cooling fins defining external threads;

an LED light board on an upper end of the heat sink, the LED light board comprising at least one LED light;

a pressure ring on the upper end of the heat sink, the pressure ring surrounding the LED light board;

a translucent cover configured to cover the LED light board;

a bottom case assembly coupled to a lower end of the heat sink opposite to the upper end of the heat sink, the bottom case assembly comprising:

a case body comprising a level projection recessed below an upper end of the case body; and a power driver module electrically coupled to the LED light board, the power driver module comprising a circuit board supported on the leveling projection;

a cover coupled to a bottom end of the case body;

a bracket configured to couple the LED light bulb to a lighting fixture; and a plurality of fasteners coupling the bracket to the cover and the case body of the bottom case assembly and coupling the bottom case assembly to the lower end of the heat sink.

* * * * *